US009656727B1

(12) United States Patent
Stewart

(10) Patent No.: US 9,656,727 B1
(45) Date of Patent: May 23, 2017

(54) ANCHOR POLE SECUREMENT DEVICE

(71) Applicant: Bernard Stewart, York, PA (US)

(72) Inventor: Bernard Stewart, York, PA (US)

( * ) Notice: Subject to any disclaimer, the term of this patent is extended or adjusted under 35 U.S.C. 154(b) by 0 days.

(21) Appl. No.: 15/142,020

(22) Filed: Apr. 29, 2016

Related U.S. Application Data

(60) Provisional application No. 62/176,811, filed on Mar. 2, 2015.

(51) Int. Cl.
*B63B 22/02* (2006.01)
*B63B 21/26* (2006.01)

(52) U.S. Cl.
CPC ..... *B63B 21/26* (2013.01); *B63B 2021/265* (2013.01)

(58) Field of Classification Search
CPC ..... B63B 21/26
See application file for complete search history.

(56) References Cited

U.S. PATENT DOCUMENTS 7,870,829 B1 1/2011 Perry et al.
2009/0223428 A1* 9/2009 Kivi ..... B63B 21/00 114/230.1
2015/0116496 A1* 4/2015 Ottaviano ..... H04N 7/185 348/148

* cited by examiner

*Primary Examiner* — Stephen Avila
(74) *Attorney, Agent, or Firm* — Hooker & Habib, P.C.

(57) ABSTRACT

A boat anchoring system that includes a base, a pulley attached to the base, a line, and an anchor pole. The line extends over the pulley, through the first hole, and is attached to the lower end portion of the anchor pole. The line controls the relative position of the anchor pole in the second hole for raising and lowering the anchor pole. The line can extend to the cockpit of the boat so that the position of the anchor pole is controllable from the cockpit.

6 Claims, 8 Drawing Sheets

ANCHOR POLE SECUREMENT DEVICE

RELATED APPLICATION

This application claims priority from U.S. Provisional Patent Application No. 62/176,811 filed Mar. 2, 2015, which priority application is incorporated by reference as if fully set forth herein.

FIELD OF THE DISCLOSURE

This disclosure relates to boat anchoring systems, and in particular, a boat anchoring system using an anchor pole for anchoring.

BACKGROUND OF THE DISCLOSURE

Small boats, such as kayaks, canoes, john boats, and the like, are often used in shallow water that is typically 8 feet deep or less. A stick-type anchor pole (also known as an anchor stick or anchor pole) is often used to anchor the boat in shallow water. One end of the anchor pole has a sharpened tip. In use, the tip of the anchor pole is pushed into the bed of the body of water. The anchor pole is then tethered to the boat or otherwise attached to the boat to anchor the boat in place.

There is a need for an improved boat anchoring system for small boats that enables a boater to raise and lower an anchor pole without the need to leave the boat cockpit.

BRIEF SUMMARY OF THE DISCLOSURE

Disclosed is a boat anchoring system that includes a base, a pulley attached to the base, a line, and an anchor pole.

The anchor pole includes a tip on a first end portion of the anchor pole and extending to a second end portion axially opposite the first end portion.

The base includes a mounting portion for attaching the boat anchoring system to a boat, an extension portion adjacent the mounting portion, and first and second holes extending through the extension portion of the base.

The first hole extends along a hole axis substantially tangential with the pulley. The second hole receives the first end portion of the anchor pole, the first end portion of the anchor pole being movable in the second hole.

The line extends over the pulley, through the first hole, and is attached to the lower end portion of the anchor pole, In use, the line controls the relative position of the anchor pole in the second hole for raising and lowering the anchor pole.

The line preferably extends to a cockpit of the boat so that the position of the anchor pole is controllable from the cockpit. A cleat in the cockpit secures the line to maintain the anchor pole in raised or lowered positions.

Other objects and features of the disclosure will become apparent as the description proceeds, especially when taken in conjunction with the detailed description and accompanying drawing sheets.

DETAILED DESCRIPTION

Figure 1:
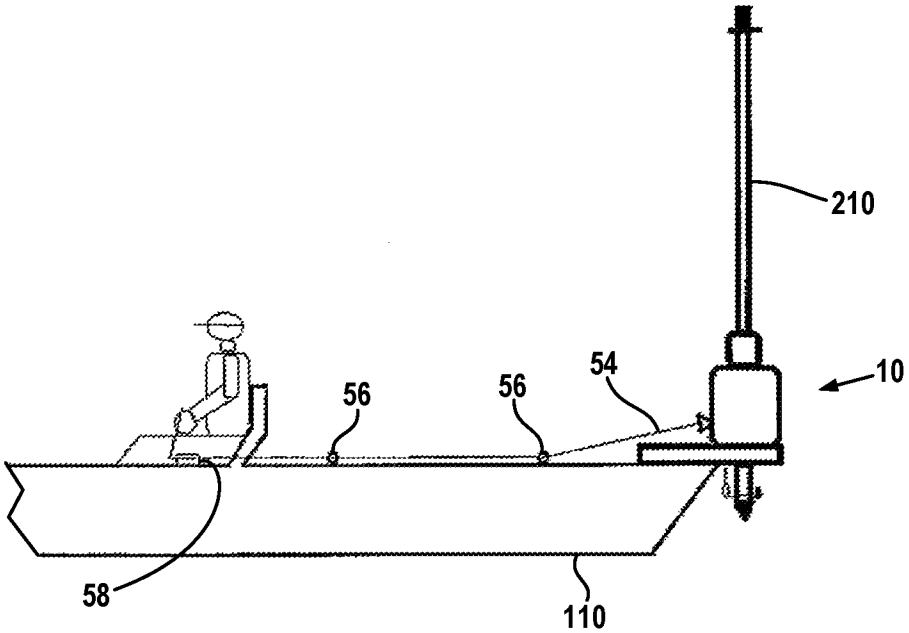
FIG. 1 is a side view of the disclosed anchor pole securement device mounted on the stern of a small boat, the securement device holding an anchor pole in a raised, stowed position above the water line.
Figure 2:
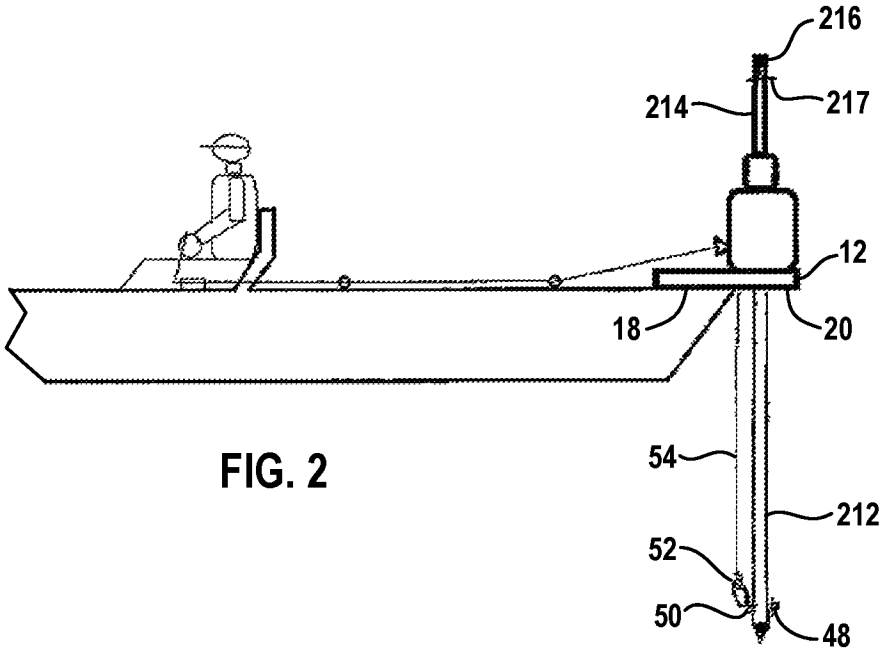
FIG. 2 is similar to FIG. 1 but shows the anchor pole in a lowered position as when the anchor pole is anchoring the boat.
Figure 3:
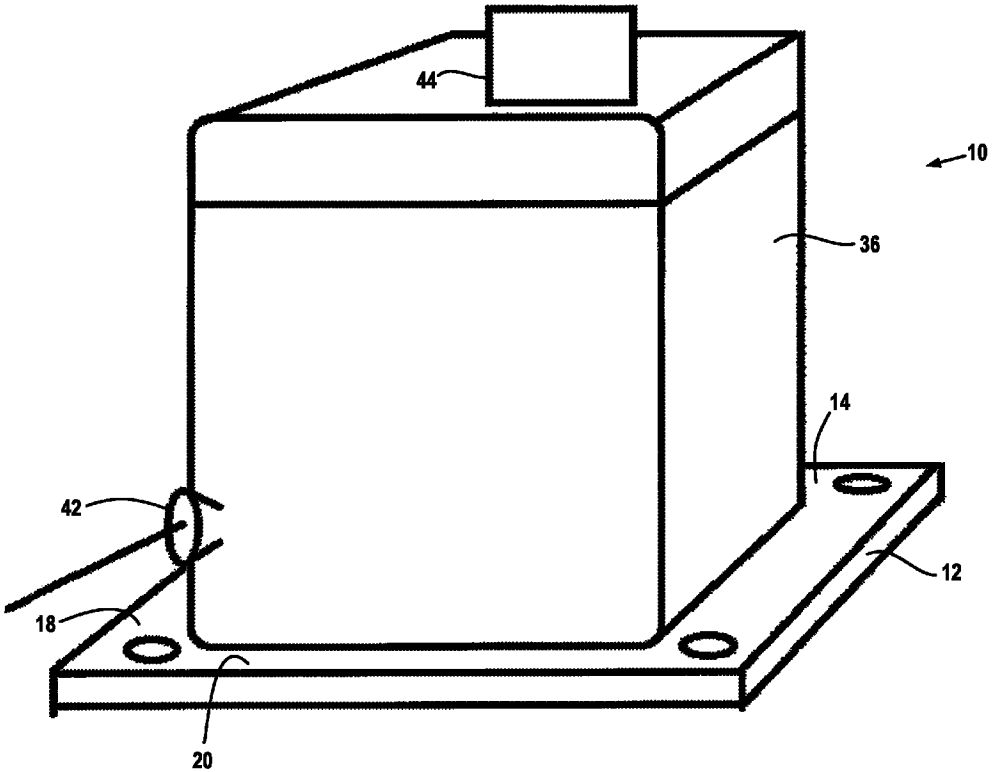
FIG. 3 is a side oblique view of the anchor pole securement device.
Figure 4:
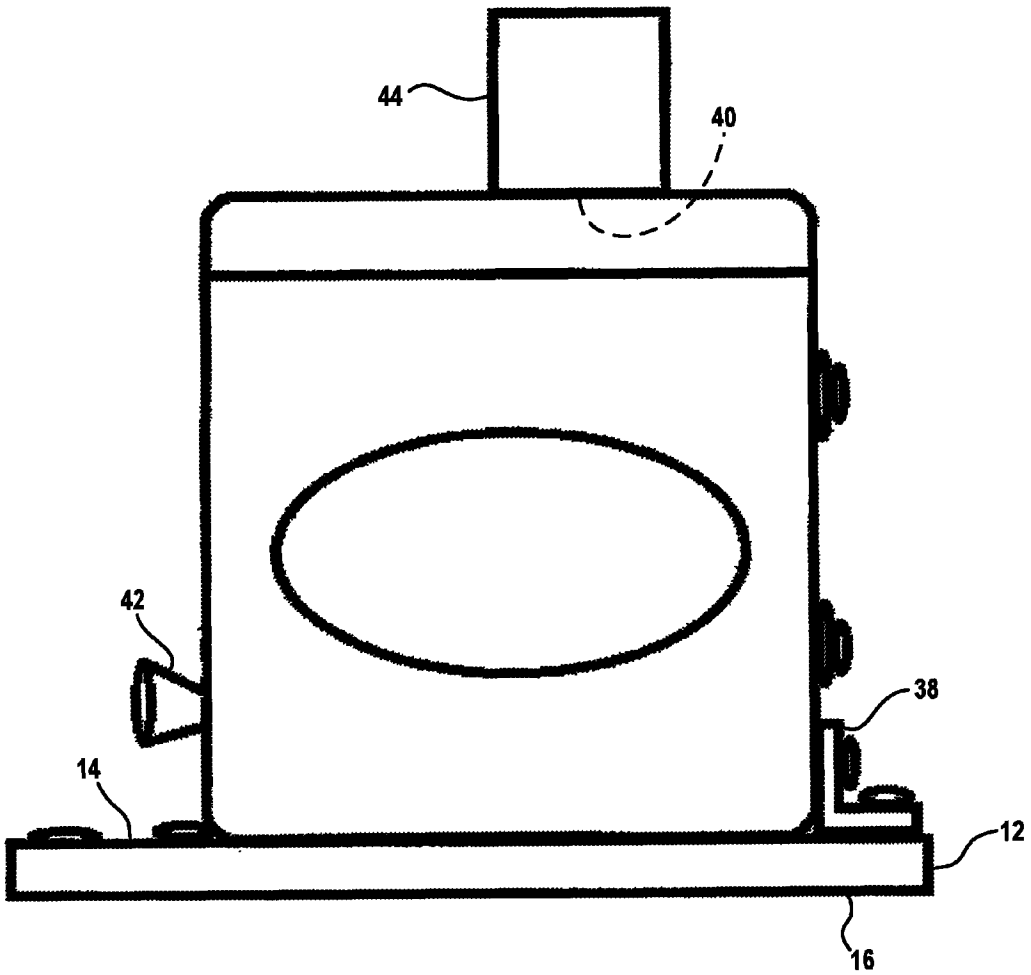
FIG. 4 is a side view of the anchor pole securement device.
Figure 5:
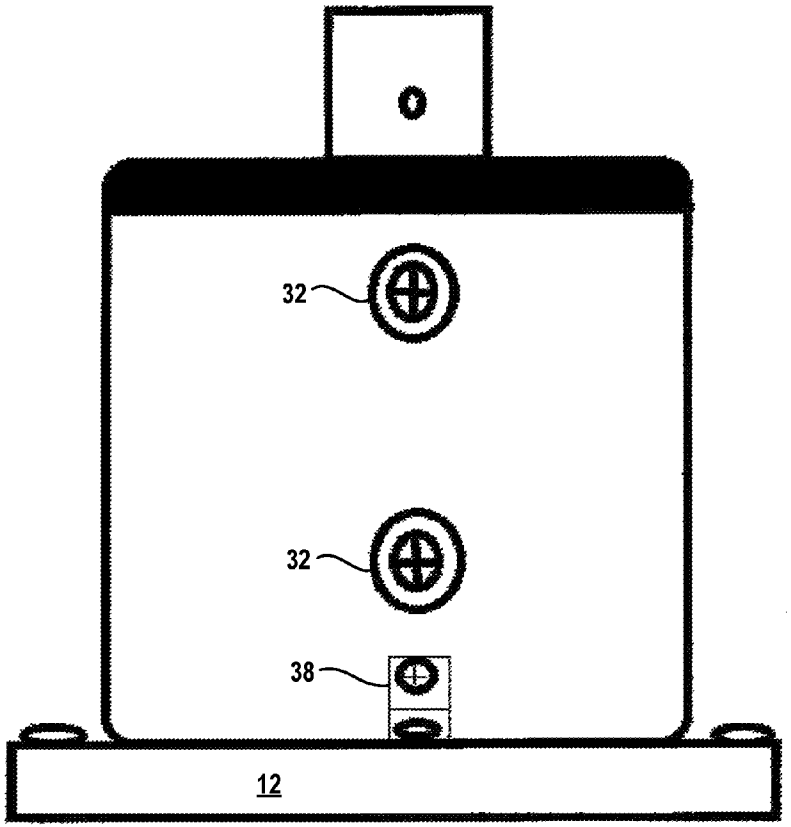
FIG. 5 is an end view of the anchor pole securement device.
Figure 6:
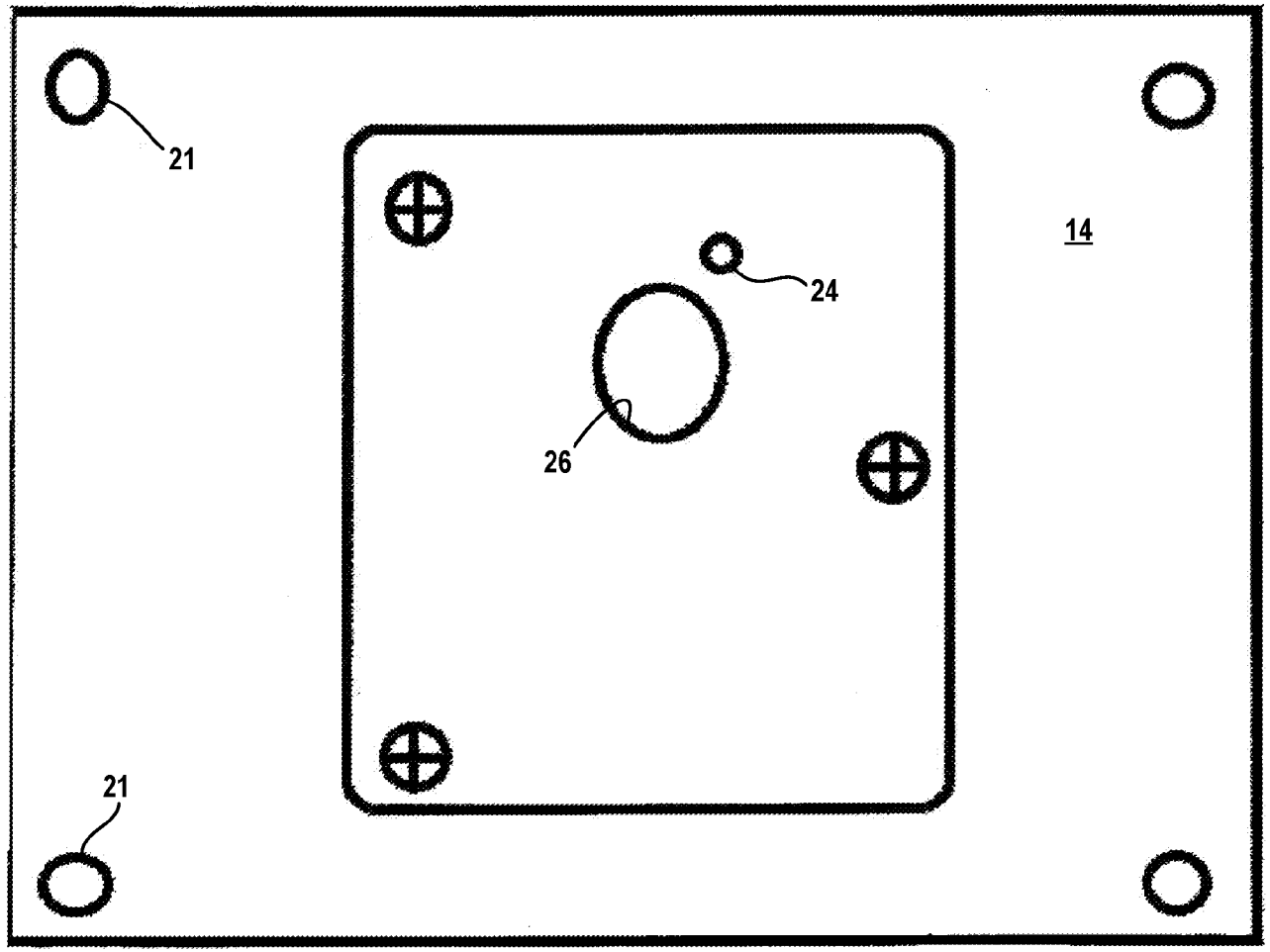
FIG. 6 is a horizontal sectional view taken along line 6-6 of FIG. 4 but omitting the components mounted in or to the housing.
Figure 7:
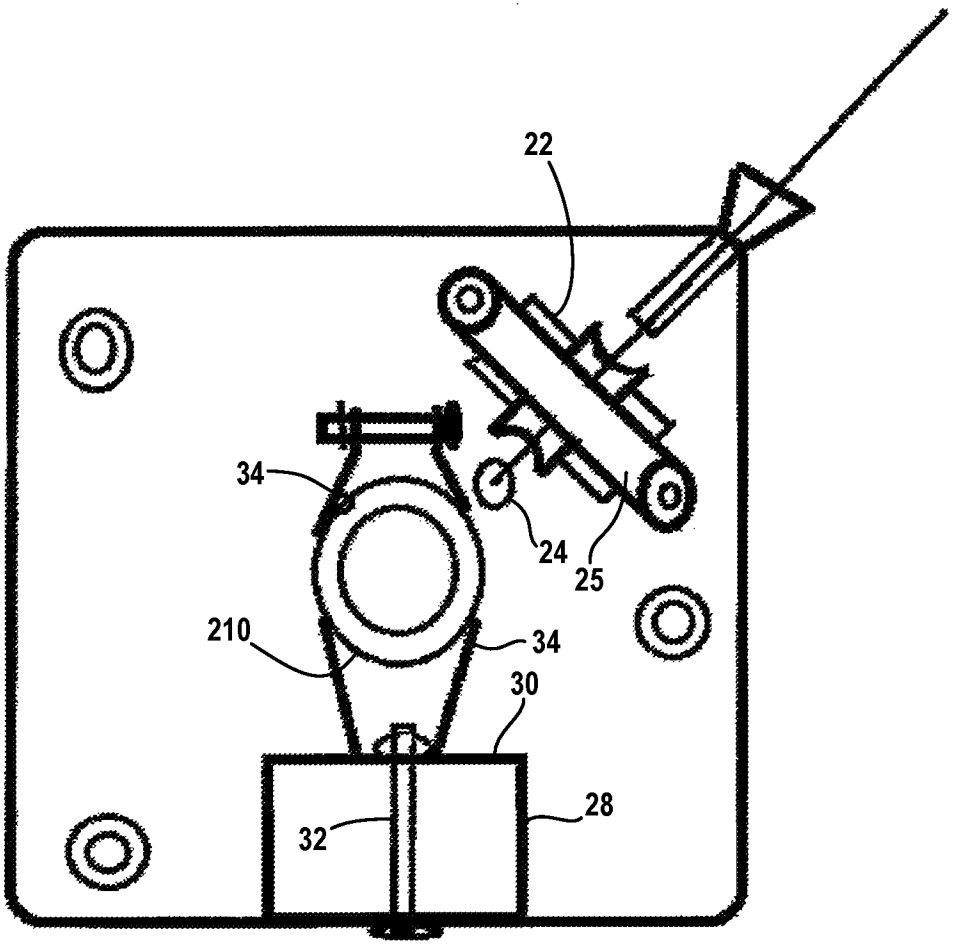
FIG. 7 is similar to FIG. 6 but illustrating the components housed in the housing.
Figure 8:
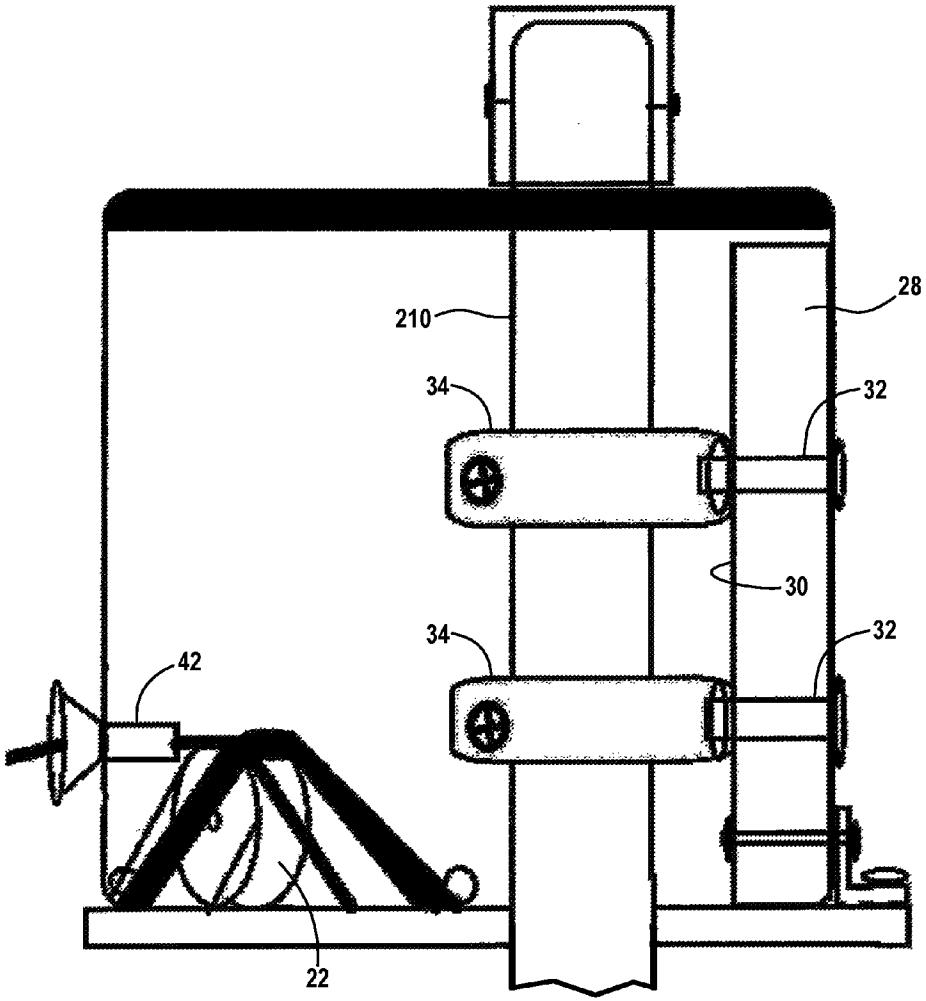
FIG. 8 is a vertical sectional view taken along line 8-8 of FIG. 5.

FIGS. 1 and 2 illustrate an embodiment of the disclosed anchor pole securement device 10 mounted on the stern of a boat 110. The anchor pole securement device releasably secures an anchor pole 210 to the boat. FIG. 1 shows the anchor pole in a raised position for stowage. FIG. 2 shows the anchor pole in a lowered position for anchoring the boat in the water. The anchor pole 210 is a conventional anchor pole and so will not be described in great detail. The illustrated anchor pole is made primarily of solid fiberglass having a three-quarter inch diameter and includes a lower end portion 212 having a pointed tip made of stainless steel and an upper end portion 214. A rubber cap 216 is attached to the top of the anchor pole with an O-ring 217. In other embodiments the anchor pole may include a conventional handle (e.g, a "D" handle or "T" handle) attached to the top of the anchor pole as is known in the anchor pole art.

FIGS. 3-8 illustrate the anchor pole securement device 10. The securement device 10 is generally box-shaped and includes a base 12 that fixedly attaches the device to a boat 110. The illustrated base is formed as a uniform one-half inch thick plate having a flat upper surface 14 defining a horizontal plane and a flat lower surface 16 separated by the thickness of the plate. The base includes a mounting portion 18 that rests on the boat and an extension portion 20 that overhangs the boat when the base is attached to the boat. Bolt through holes 21 receive threaded fasteners (not shown) that removably attach the base to the boat in a conventional manner.

Mounted on the upper surface 14 of the base extension 20 is a fixed pulley 22 for use with a line or cord when operating the securement device. The pulley rotates in a vertical plane with respect to the base surface that intersects the base mounting portion 18. The pulley is aligned with a side of a vertical through-hole 24 extending through the base 12. A line retainer 25 extends across the pulley 22.

Closely spaced from the other side of the through-hole 24 is a larger vertical through-hole 26 extending through the base 12. The through-hole 26 is sized to closely receive the anchor pole.

Also mounted on the upper surface 14 adjacent to a side of the through-hole 26 is a vertically elongate support member 28 having a flat surface 30 facing the hole 26. Attached to the surface 30 by bolts 32 are vertically spaced pairs apart curved brackets 34 that extend over the hole 26. The brackets 34 of each pair of brackets face one another and define an opening therebetween coaxial with the hole 26 to receive the anchor pole between them. The size of the opening between the pairs of brackets is user-adjustable by turning the bolts 32.

A housing 36 mounted on the base extension portion 20 cooperates with the base surface 14 to define an interior volume containing the pulley 22, support member 28, and the brackets 34. The housing is attached to the base by an L-shaped channel 38. The bolts 32 extend through the housing wall for additional support of the support member 28.

A through-opening 38 is formed in the housing adjacent to the pulley 22 for access to the pulley. A second through-opening 40 coaxial with the through-hole 26 is located at the top of the housing to receive the anchor pole into the housing.

An outwardly flaring tubular sleeve 42 extends through the housing from an enlarged end outside of the housing to an opposite end inside of the housing closely spaced from the pulley 22. The sleeve 42 is axially aligned with the plane of rotation of the pulley tangential to the upper side of the pulley. A vertical sleeve 44 is attached to the top of the housing and has an inner annular wall coaxial with and closely surrounding the through-opening 28.

The anchoring system further includes a ring pin 48 attached to the anchor pole 210 (see FIG. 2). The ring pin 48 extends through the lower end portion of the anchor pole near the tip of the anchor pole. The ring pin 48 has an exposed ring 50 for attachment of a carabiner 52.

The base mounting portion 18 is supported against the boat and the base overhanging portion 20 extending beyond the rear of the boat. A line or cord 54 tied to the carabiner 52 extends through the through-hole 26, over the pulley 22, through the intake sleeve 42, and to the boat cockpit as shown in FIGS. 1 and 2. The line passes from the device 10 to the boat cockpit through eye pads or guide pulleys 56 attached to and spaced along the boat deck. A cleat 58 is mounted in the cockpit to secure the free end of the line. The cleat 58 is conventional and can be a cam cleat or horn cleat.

In operation, the bolts 32 are loosened to enable the anchor pole to slide freely between the pairs of brackets 34. The boater while in the boat cockpit as shown in FIG. 1 pulls on the line 54 to raise the anchor pole above the water and to the raised, stowed position shown in FIG. 1. The ring pin 48 interferes with the base 12 and thereby limits upward movement of the anchor pole. The free end of the line is secured to the cleat 58 so that the line holds the anchor pole in the raised position.

To anchor the boat the free end of the line is released from the cleat 58 and the anchor pole is allowed to fall into the water. The handle 216 interferes with the upper sleeve 44 and thereby limits downward movement of the anchor pole. The tip of the anchor pole embeds into the bed and functions as an anchor connected to the boat by the line 54. The free end of the line is again secured to the cleat 58.

To raise the anchor pole back to the stowed position the free end of the line 54 is released from the cleat 58. The boater pulls on the line to return the anchor pole to the raised position.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art, as well as such changes and alterations that fall within the purview of the following claims.

The invention claimed is:

1. A boat comprising:

a cockpit, a cleat in the cockpit, and a boat anchoring system;

the boat anchoring system comprising:

a base, a pulley attached to the base, a line, and an anchor pole;

the anchor pole comprising a tip on a first end portion of the anchor pole and extending to a second end portion axially opposite the first end portion;

the base comprising a mounting portion, an extension portion adjacent the mounting portion, and first and second holes extending through the extension portion of the base, the mounting portion of the base being attached to the boat by one or more fasteners and the extension portion of the base extends away from the boat;

the first hole extending along a hole axis substantially tangential with the pulley;

the second hole receiving the first end portion of the anchor pole, the first end portion of the anchor pole movable in the second hole;

the line extending over the pulley, through the first hole, and attached to the lower end portion of the anchor pole, and the line extending to the cockpit and securable to the cleat, whereby the line controls the relative position of the anchor pole in the second hole for raising and lowering the anchor pole.

2. The boat of claim 1 wherein the boat anchoring system includes a housing defining an interior volume, the housing attached to the base, the pulley in the housing volume.

3. The boat of claim 2 wherein the housing includes an opening aligned with the second hole in the base, the anchor pole extending through the housing opening.

4. A boat anchoring system comprising:

a base, a pulley attached to the base, a line, a housing, and an anchor pole; including a housing defining an interior volume, the housing attached to the base, the pulley in the housing volume the housing defining an interior volume, the housing attached to the base, the pulley in the housing volume;

the anchor pole comprising a tip on a first end portion of the anchor pole and extending to a second end portion axially opposite the first end portion;

the base comprising a mounting portion, an extension portion adjacent the mounting portion, and first and second holes extending through the extension portion of the base;

the first hole extending along a hole axis substantially tangential with the pulley;

the second hole receiving the first end portion of the anchor pole, the first end portion of the anchor pole movable in the second hole;

the housing includes an opening aligned with the second hole in the base, the anchor pole extending through the housing opening;

the line extending over the pulley, through the first hole, and attached to the lower end portion of the anchor pole, whereby the line controls the relative position of the anchor pole in the second hole for raising and lowering the anchor pole.

5. The boat anchoring system of claim 4 in combination with a boat wherein the mounting portion of the base is attached to the boat by one or more fasteners.

6. The boat and boat anchoring system of claim 5 wherein the extension portion of the base extends away from the boat.

* * * * *